US007761939B2

(12) United States Patent
Wiggins et al.

(10) Patent No.: US 7,761,939 B2
(45) Date of Patent: Jul. 27, 2010

(54) SIDERAIL SPRING DAMPENER

(75) Inventors: Brian T. Wiggins, Burlington, KY (US); Darrell L. Metz, Batesville, IN (US); Terry J. Stratman, Villa Hills, KY (US)

(73) Assignee: Hill-Rom Services, Inc., Wilmington, DE (US)

( * ) Notice: Subject to any disclaimer, the term of this patent is extended or adjusted under 35 U.S.C. 154(b) by 255 days.

(21) Appl. No.: 11/244,939

(22) Filed: Oct. 6, 2005

(65) Prior Publication Data

US 2006/0107460 A1 May 25, 2006

Related U.S. Application Data

(60) Provisional application No. 60/626,495, filed on Nov. 10, 2004.

(51) Int. Cl.
*A61G 7/00* (2006.01)

(52) U.S. Cl. ..... 5/430; 5/424; 5/428

(58) Field of Classification Search ..... 5/424–425, 5/428–430; 267/140.2, 175, 177
See application file for complete search history.

(56) References Cited

U.S. PATENT DOCUMENTS

| | | | | |
|---|---|---|---|---|
| 3,932,903 | A | | 1/1976 | Adams et al. |
| 4,385,754 | A | * | 5/1983 | Waite ..... 267/71 |
| 4,612,679 | A | | 9/1986 | Mitchell |
| 5,044,614 | A | * | 9/1991 | Rau ..... 267/221 |
| 5,083,334 | A | | 1/1992 | Huck et al. |
| 5,129,117 | A | | 7/1992 | Celestina et al. |
| 5,279,010 | A | | 1/1994 | Ferrand et al. |
| 5,715,548 | A | | 2/1998 | Weismiller et al. |
| 5,732,423 | A | | 3/1998 | Weismiller et al. |
| 5,802,640 | A | | 9/1998 | Ferrand et al. |
| 5,906,016 | A | | 5/1999 | Ferrand et al. |
| 6,182,310 | B1 | | 2/2001 | Weismiller et al. |
| 6,779,209 | B2 | | 8/2004 | Ganance |

* cited by examiner

*Primary Examiner*—Fredrick Conley
(74) *Attorney, Agent, or Firm*—Jason A. Penninger

(57) ABSTRACT

A patient support comprises a frame, a siderail, a linkage coupled to the siderail and coupled to the frame to guide movement of the siderail relative to the frame between a raised position and a lowered position, and a dampener. The dampener includes a coil spring, a first link coupled to the linkage and having a free end received inside the coil spring, and a second link coupled to the frame and having a free end received inside the coil spring.

21 Claims, 9 Drawing Sheets

SIDERAIL SPRING DAMPENER

CROSS REFERENCE TO RELATED APPLICATION

This application claims the benefit, under 35 U.S.C. §119 (e), of U.S. Provisional Patent Application Ser. No. 60/626,495, which was filed Nov. 10, 2004 and which is hereby incorporated by reference herein in its entirety.

BACKGROUND OF THE INVENTION

The present disclosure relates to patient supports, such as hospital beds, and more particularly to siderails for patient supports.

Hospital beds and other patient supports are known. Many such patient supports include a base frame supported on casters, an intermediate frame, an articulating deck, and siderails movable between raised and lowered positions. Such beds may include gas springs or dashpots to prevent rapid lowering of the siderails when the siderails are lowered. An illustrative hospital bed having gas springs for preventing rapid lowering of the siderails is disclosed in U.S. Pat. No. 6,779,209, which is hereby expressly incorporated herein by reference.

SUMMARY OF THE INVENTION

The present invention comprises an apparatus having one or more of the features recited in the claims or one or more of the following features, which alone or in any combination may comprise patentable subject matter:

A patient support may include a frame, a siderail, a linkage coupled to the siderail and coupled to the frame to guide movement of the siderail relative to the frame between a raised position and a lowered position, and a dampener to resist downward movement of the siderail.

The dampener may include a coil spring, a first link coupled to the linkage and having a free end received inside the coil spring, and a second link coupled to the frame and having a free end received inside the coil spring. The free ends of the links may overlap. The free ends of the links may slide relative to each other. The first and second links may extend generally parallel to the axis of the spring.

The dampener may resist downward movement of the siderail during a first range of movement, and may assist downward movement of the siderail during a second range of movement. The siderail may have an overcenter position intermediate of the raised and lowered positions. The dampener may be configured to bias the siderail toward the lowered position after the siderail passes the overcenter position during downward movement thereof.

The patient support may have a first bracket coupled to the frame and coupled to the linkage. The patient support may have a second bracket coupled to the linkage and coupled to the siderail. The linkage may comprise a center arm and a pair of outer arms positioned on the opposite sides of the center arm. The first bracket, the second bracket, the center arm and the outer arms may form a four bar linkage.

The center arm may have a proximal end coupled to the first bracket for pivoting movement about a first axis and a distal end coupled to the second bracket for pivoting movement about a second axis. Each outer arm may have a proximal end coupled to the first bracket for pivoting movement about a third axis and a distal end coupled to the second bracket for pivoting movement about a fourth axis.

The first and second axes may be positioned below the respective third and fourth axes. The first and third axes may define a first plane extending along a length dimension of the frame. The second and fourth axes may define a second plane extending along the length dimension of the frame. The first and second planes may be generally vertical.

The siderail may have an upper portion situated above the frame when the siderail is raised and below the frame when the siderail is lowered.

The first link may have a mount end coupled to the center arm for pivoting movement about a fifth axis and a free end received inside the coil spring. The second link may have a mount end coupled to the first bracket for pivoting movement about a sixth axis and a free end received inside the coil spring. The fifth axis may be positioned below the sixth axis.

The patient support may include an articulating deck having a head section, and the first bracket may be coupled to the head section for movement therewith. The patient support may include an intermediate frame, and the first bracket may be coupled to the intermediate frame.

Additional features, which alone or in combination with any other feature(s), including those listed above and those listed in the appended claims, may comprise patentable subject matter and will become apparent to those skilled in the art upon consideration of the following detailed description of an illustrative embodiment exemplifying the best mode for carrying out the invention as presently perceived.

BRIEF DESCRIPTION OF THE DRAWINGS

The detailed description particularly refers to the accompanying figures, in which.

DETAILED DESCRIPTION OF THE DRAWINGS

Figure 1:
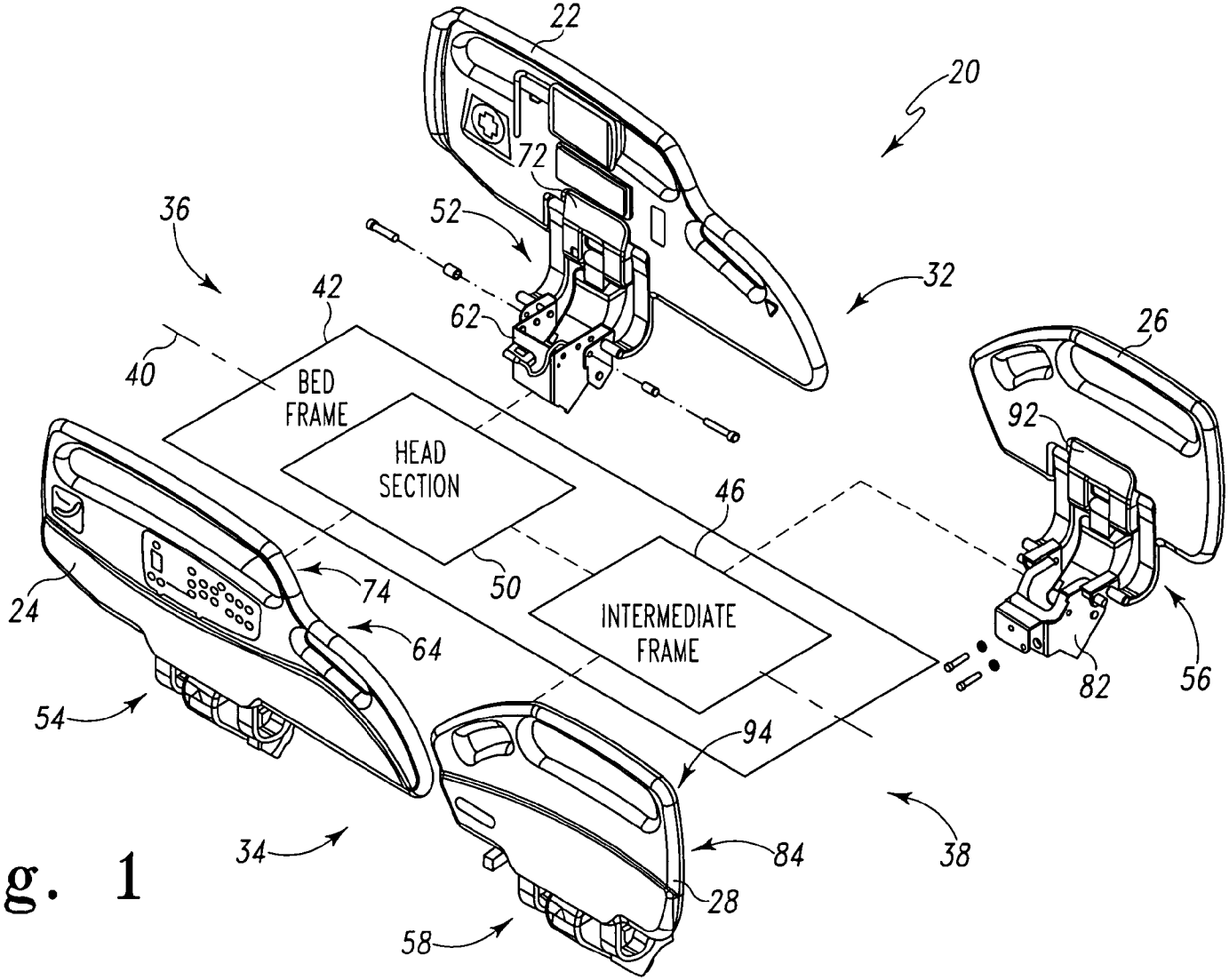
FIG. 1 is a perspective view, partly diagrammatic, of a hospital bed showing the bed including a base frame, an intermediate frame, a head section, a pair of head end siderails and a pair of foot end siderails.

A hospital bed 20 includes a pair of head end siderails 22, 24 and a pair of foot end siderails 26, 28 as shown in FIG. 1. A spring dampener 30 is associated with each siderails 22, 24, 26, 28 to prevent its rapid lowering. Each spring dampener 30 includes a coil spring 252 which is compressed when the associated siderail 22, 24, 26, 28 is lowered. The bed 20 has a left side 32, a right side 34, a head end 36, a foot end 38, and a longitudinal axis 40. As used in this description, the phrase "left side 32" will be used to denote the side of any referred-to object that is positioned to lie nearest the left side 32 of the bed 20 and the phrase "right side 34" will be used to denote the side of any referred-to object that is positioned to lie nearest the right side 34 of the bed 20. Likewise, the phrase "head end 36" will be used to denote the end of any referred-to object that is positioned to lie nearest the head end 36 of the bed 20, and the phrase "foot end 38" will be used to denote the end of any referred-to object that is positioned to lie nearest the foot end 38 of the bed 20.

The bed 20 includes a bed frame 42 as shown diagrammatically in FIG. 1. In some embodiments, casters are coupled to the bed frame 42 to allow the bed 20 to be maneuvered along a floor. The bed frame includes an intermediate frame 46 and a head section 50. The head section 50 is part of a patient support deck which includes other deck sections (not shown). At least some of the deck sections, including the head section 50, are movable to various positions relative to the intermediate frame 46. For example, the head section 50 is movable between raised and lowered positions relative to intermediate frame 46. In some embodiments, the bed frame 42 includes a base frame and elevation mechanisms that raise, lower, and tilt the intermediate frame 46 relative to the base frame.

In the illustrative example, the head end siderails 22, 24 are coupled to the respective left and right sides 32, 34 of the head section 50 for movement therewith between the raised and lowered positions. The foot end siderails 26, 28 are coupled to the respective left and right sides 32, 34 of the intermediate frame 46 near the foot end 38. The head end siderails 22, 24 are generally mirror images of each other although, in some embodiments, there may be some differences between the siderails 22, 24, such as the type of controls, or indicia coupled thereto. The foot end siderails 26, 28 are also generally mirror images of each other.

Figure 5:
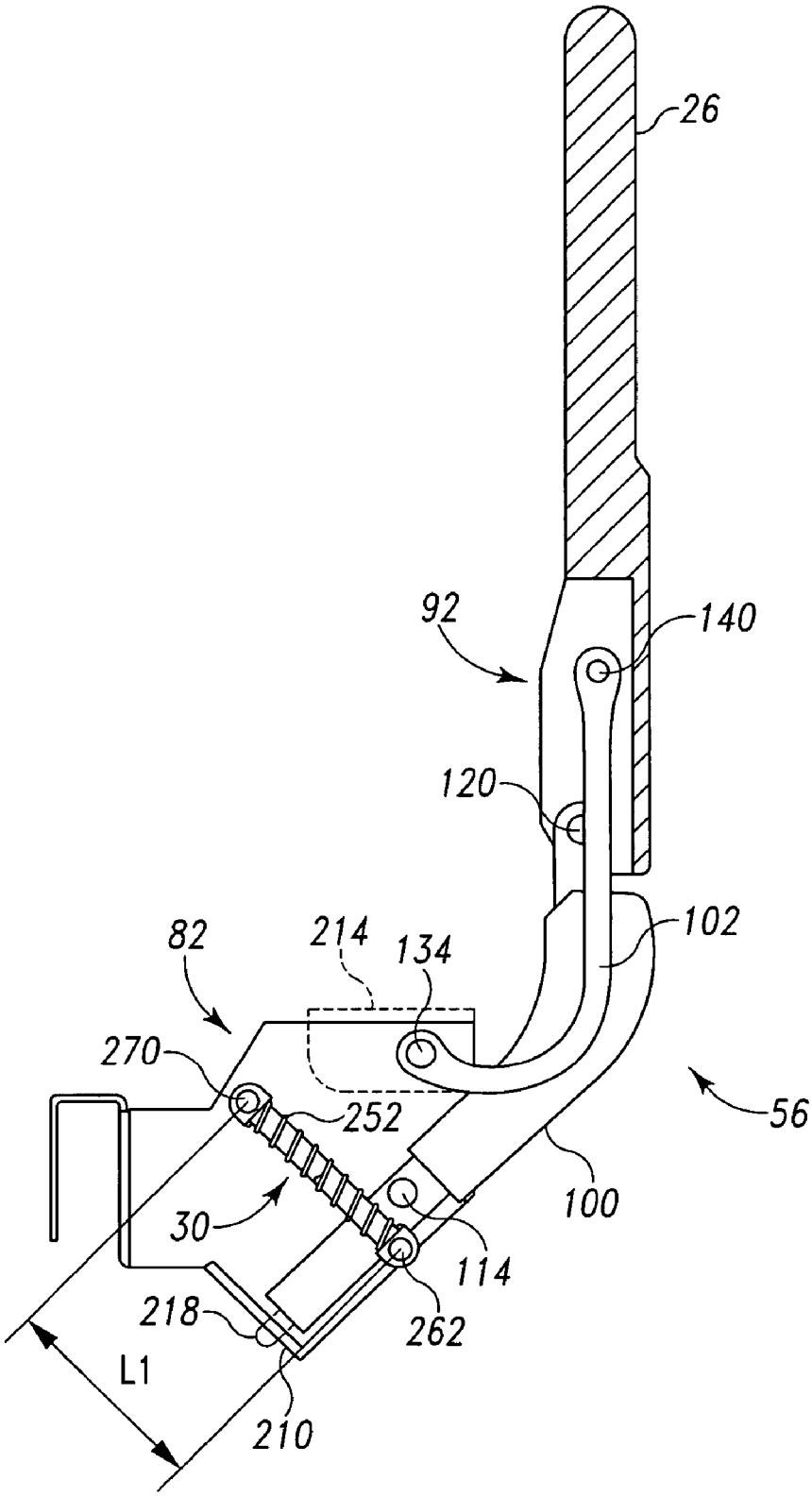
FIG. 5 is an end elevation view of a foot end siderail in a raised position.
Figure 7:
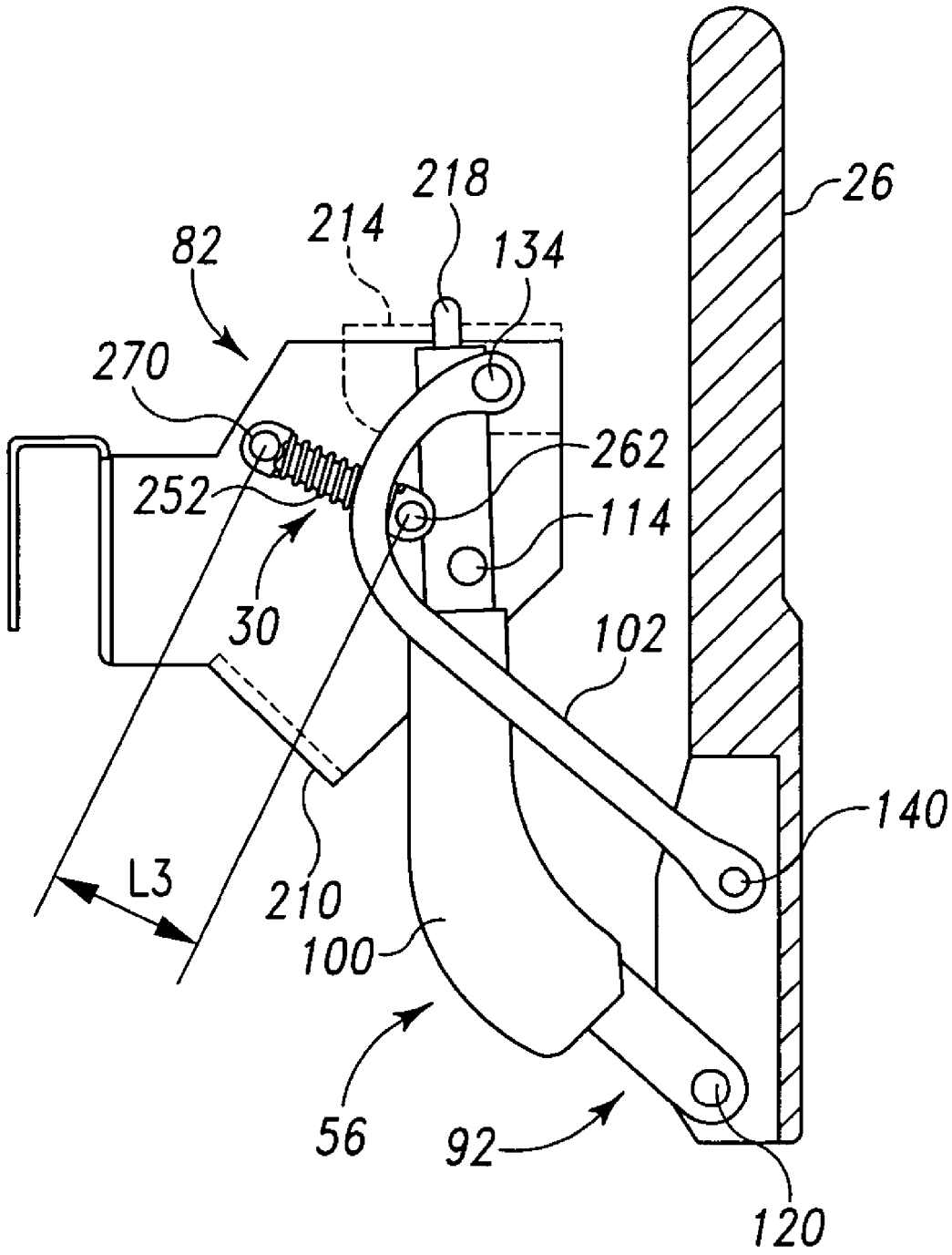
FIG. 7 is an end elevation view of a foot end siderail in a lowered position.

Each siderail 22, 24, 26, 28 is movable between a raised position as shown, for example, in FIG. 5 with respect to siderail 26 and a lowered position as shown, for example, in FIG. 7 also with respect to siderail 26. Each head end siderail 22, 24 has an upper portion that is situated above the head section 50 when the siderail 22, 24 is raised and situated below the head section 50 when the siderail 22, 24 is lowered. Each foot end siderail 26, 28 has an upper portion that is situated above the intermediate frame 46 when the siderail 26, 28 is raised and situated below the intermediate frame 46 when the siderail 26, 28 is lowered. In the raised position, the siderails 22, 24, 26, 28 block entry and egress of patients into and out of the bed 20. In the lowered position, the siderails 22, 24, 26, 28 permit entry and egress of patients into and out of the bed 20.

The head end siderails 22, 24 are coupled to the respective left and right sides 32, 34 of the head section 50 by associated head end linkages 52, 54. The head end linkages 52, 54 are generally mirror images of each other. The foot end siderails 26, 28 are coupled to the respective left and right sides 32, 34 of the intermediate frame 46 by associated foot end linkages 56, 58. The foot end linkages 56, 58 are also generally mirror images of each other.

A frame mounting bracket 62 is coupled to the left side 32 of the head section 50 and coupled to the head end linkage 52. A siderail mounting bracket 72 is coupled to the head end linkage 52 and coupled to the head end siderail 22 on the left side 32 of the bed 20. A frame mounting bracket 64 is coupled to the right side 34 of the head section 50 and coupled to the head end linkage 54. A siderail mounting bracket 74 is coupled to the head end linkage 54 and coupled to the head end siderail 24 on the right side 32 of the bed 20. The frame mounting brackets 62, 64 near the head end 36 of the bed 20 are generally mirror images of each other. Likewise, the siderail mounting brackets 72, 74 near the foot end 38 of the bed 20 are generally mirror images of each other.

A frame mounting bracket 82 is coupled to the left side 32 of the intermediate frame 46 and coupled to the foot end linkage 56. A siderail mounting bracket 92 is coupled to the foot end linkage 56 and coupled to the foot end siderail 26 on the left side 32 of the bed 20. A frame mounting bracket 84 is coupled to the right side 34 of the intermediate frame 46 and coupled to the foot end linkage 58. A siderail mounting bracket 94 is coupled to the foot end linkage 58 and coupled to the foot end siderail 28 on the right side 32 of the bed 20. The frame mounting brackets 82, 84 near the foot end 38 of the bed 20 are mirror images of each other. Likewise, the siderail mounting brackets 92, 94 near the foot end 38 of the bed 20 are mirror images of each other.

Figure 8:
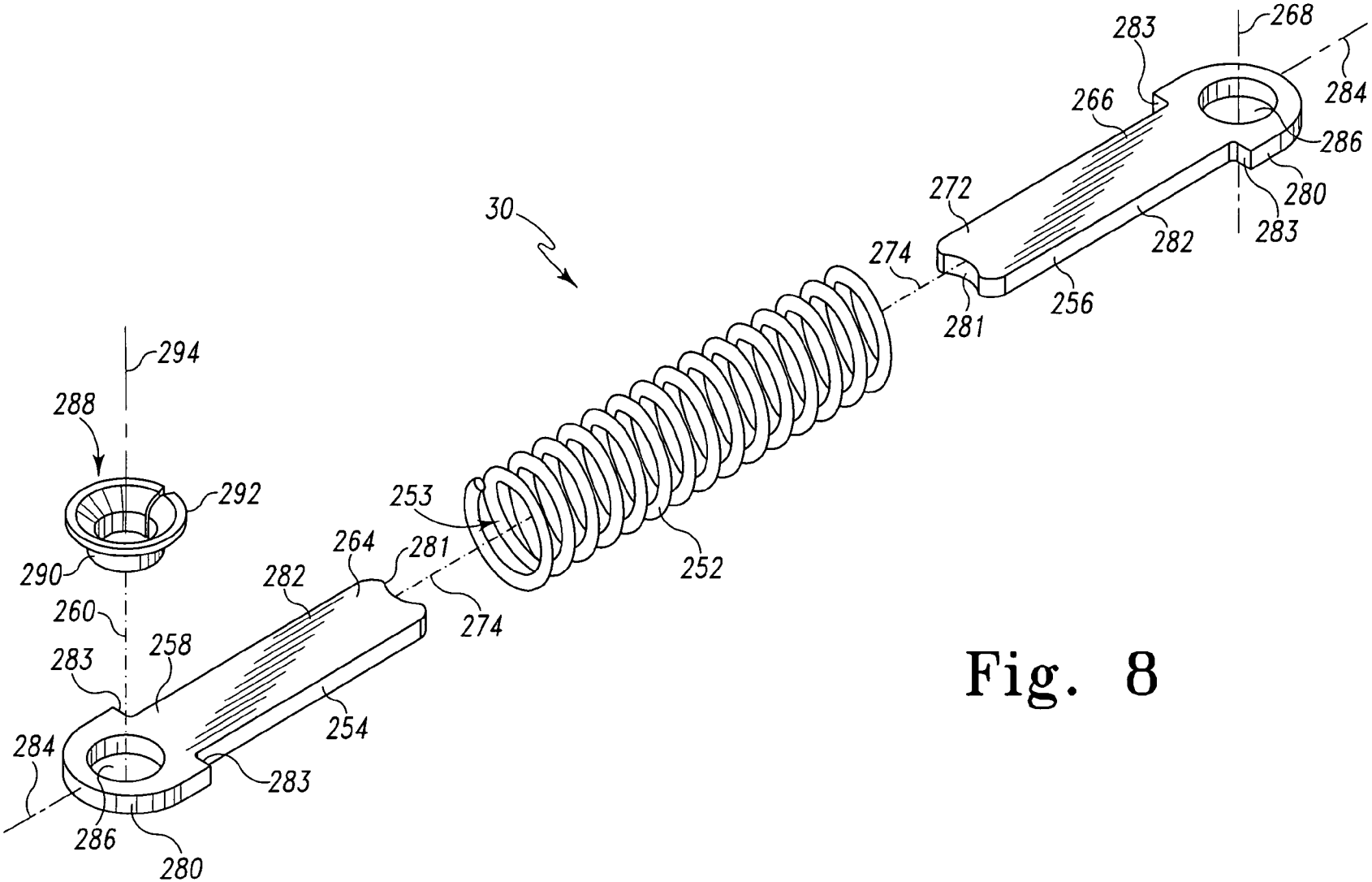
FIG. 8 is an exploded perspective view of the dampener showing a coil spring, a first link and a second link.
Figure 9:
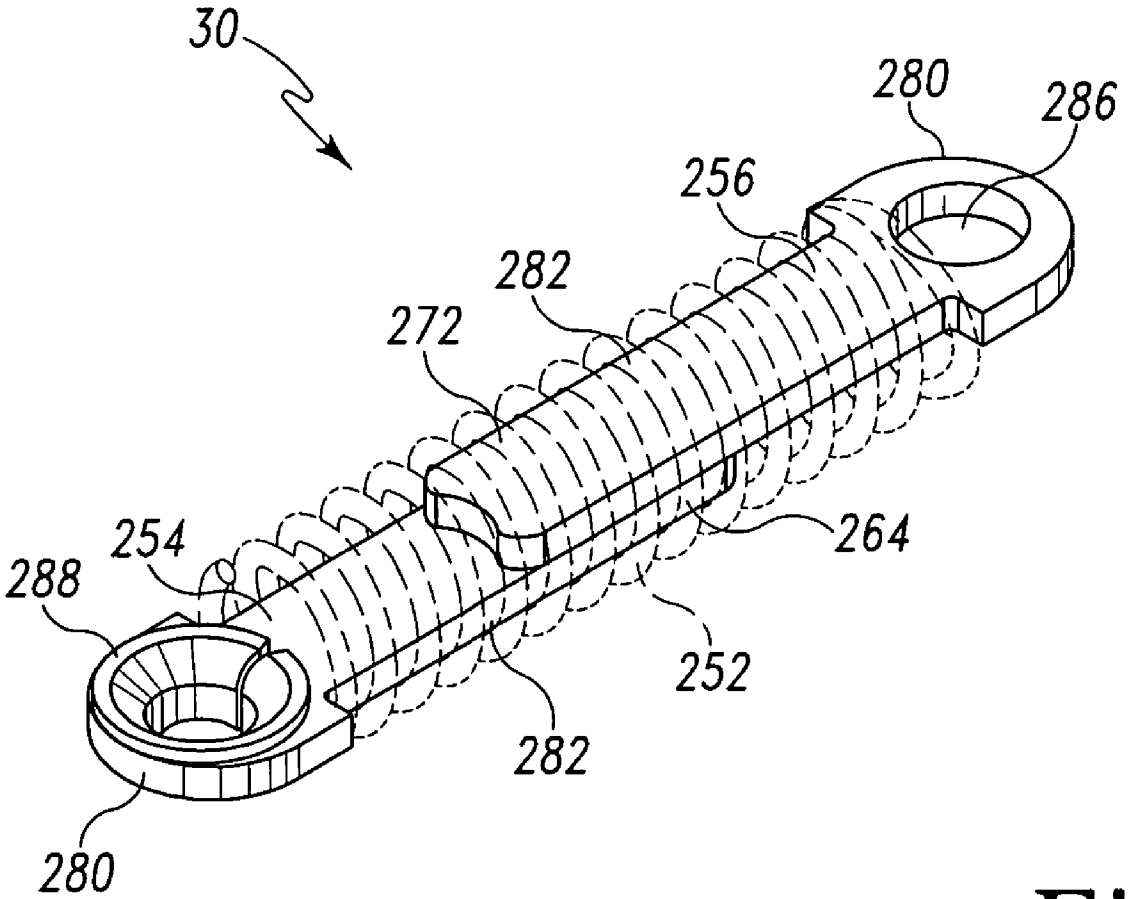
FIG. 9 is a perspective view of the dampener showing the coil spring, the first link having a free end received inside the coil spring and the second link having a free end received inside the coil spring.

As shown in FIGS. 8 and 9, each dampener 30 includes a coil spring 252, a first link 254 coupled to the associated linkage 52, 54, 56, 58 and having a free end 264 positioned inside a bore of the coil spring 252 and a second link 256 coupled to the associated frame mounting bracket 62, 64, 82, 84 and having a free end 272 positioned inside the bore of the coil spring 252. As the siderails 22, 24, 26, 28 are moved to the lowered position, the associated coil springs 252 are initially compressed to resist the downward movement of the respective siderails 22, 24, 26, 28. The spring dampeners 30 are less expensive than gas springs or dashpots used in the prior art beds.

Figure 2:
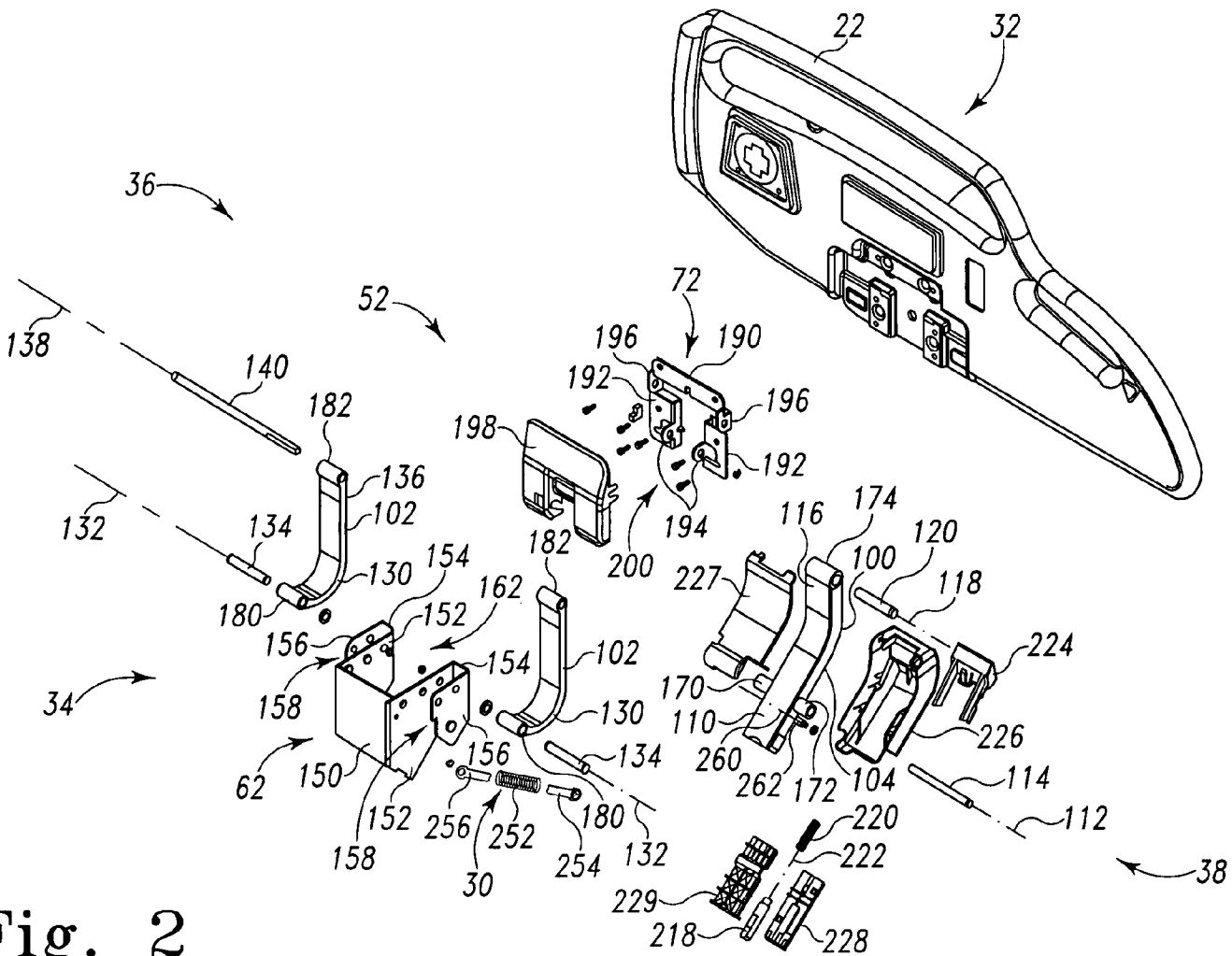
FIG. 2 is an exploded view of a linkage coupling a head end siderail to a left side of the head section showing the linkage including a frame mounting bracket, a siderail mounting bracket, a center arm, a pair of outer arms and a dampener coupled between the center arm and the frame mounting bracket.

Only the head end linkage 52 will be described in detail since all the linkages 52, 54, 56, 58 are substantially identical in their construction and operation. Likewise, only the head end frame mounting bracket 62 and the head end siderail mounting bracket 72 will be described in detail. However, in FIGS. 5-7, the foot end linkage 56 coupling the foot end frame mounting bracket 82 to the foot end siderail mounting bracket 92 is shown. As shown in FIG. 2, the head end linkage 52 includes a curved center arm 100 and a pair of curved outer arms 102 positioned on opposite sides of the center arm 100. The frame mounting bracket 62, the siderail mounting bracket 72, the center arm 100 and the outer arms 102 form a four bar or parallelogram linkage arrangement permitting the siderail 22 to swing sideways between the raised and lowered positions.

The center arm 100 has a proximal or lower end 110 coupled to the frame mounting bracket 62 for pivoting movement about a first axis 112 by a pivot pin 114. The pivot pin 114 extends through a pair of bushings 170, 172 coupled to the center arm 100. The center arm 100 has a distal or upper end 116 coupled to the siderail mounting bracket 72 for pivoting movement about a second axis 118 by a pivot pin 120. The first link 254 of the dampener 30 is coupled to the center arm 100 for pivoting movement about a pivot pin 262 shown in FIGS. 5-7 with regard to siderail 26. The pivot pin 262 is secured to an outwardly facing wall 104 of the center arm 100 near the lower end 110 thereof such that the pivot pin 262 is positioned below the bushings 170, 172 when the siderail 22 is raised (as shown in FIG. 5 with regard to the siderail 26) and above the bushings 170, 172 when the siderail 22 is lowered (as shown in FIG. 7 with regard to the siderail 26).

Each outer arm 102 has a proximal or lower end 130 coupled to the frame mounting bracket 62 for pivoting movement about a third axis 132 by a pivot pin 134. Each outer arm 102 has a distal or upper end 136 coupled to the siderail mounting bracket 72 for pivoting movement about a fourth axis 138 a pivot pin 140. As shown in FIGS. 7-9, the first and second axes 112, 118 are positioned below the respective third and fourth axes 132, 138. The first and third axes 112, 132 define a first plane extending along the longitudinal axis 40 of the bed 20. The second and fourth axes 118, 138 define a second plane extending along the longitudinal axis 40 of the bed 20.

The frame-mounting bracket 62 includes a base portion 150, a pair of inner flanges 152 extending outwardly from the base portion 150, a pair of connecting portions 154 extending forwardly and rearwardly from the respective inner flanges 152 and a pair of outer flanges 156 extending inwardly from the respective connecting portions 154. The inner flanges 152 and the associated outer flanges 156 form a pair of inwardly-opening strut-receiving spaces 158. A pair of struts (not shown) extend outwardly from the left side 32 of the head section 50. The struts are received in the respective strut-receiving spaces 158 of the frame-mounting bracket 62, and secured therein by respective screws 160.

The spaced apart inner flanges 152 form an outwardly-opening arm-receiving space 162 in which the lower end 110 of the center arm 100 is pivotally mounted for rotation about the pivot pin 114. The bushings 170, 172 extend outwardly from the lower end 110 of the center arm 100 on opposite sides thereof. The pivot pin 114 extends through respective openings in the inner and outer flanges 152, 156 of the frame mounting bracket 62 near the foot end 38 of the bed 20, through respective bores in the bushings 170, 172 of the center arm 100, and then through respective openings in the inner and outer flanges 152, 156 of the frame mounting bracket 62 near the head end 36 of the bed 20 to provide a pivotable connection therebetween. The openings in the inner and outer flanges 152, 156 of the frame mounting bracket 62 near the foot end 38, the bores in the bushings 170, 172 and the openings in the inner and outer flanges 152, 156 of the frame mounting bracket 62 near the head end 36 configured for receiving the pivot pin 114 are coaxially aligned. The spacing between outer faces of the bushings 170, 172 is slightly less than the spacing between the inner flanges 152. Retaining washers hold the pivot pin 114 in place.

Figure 3:
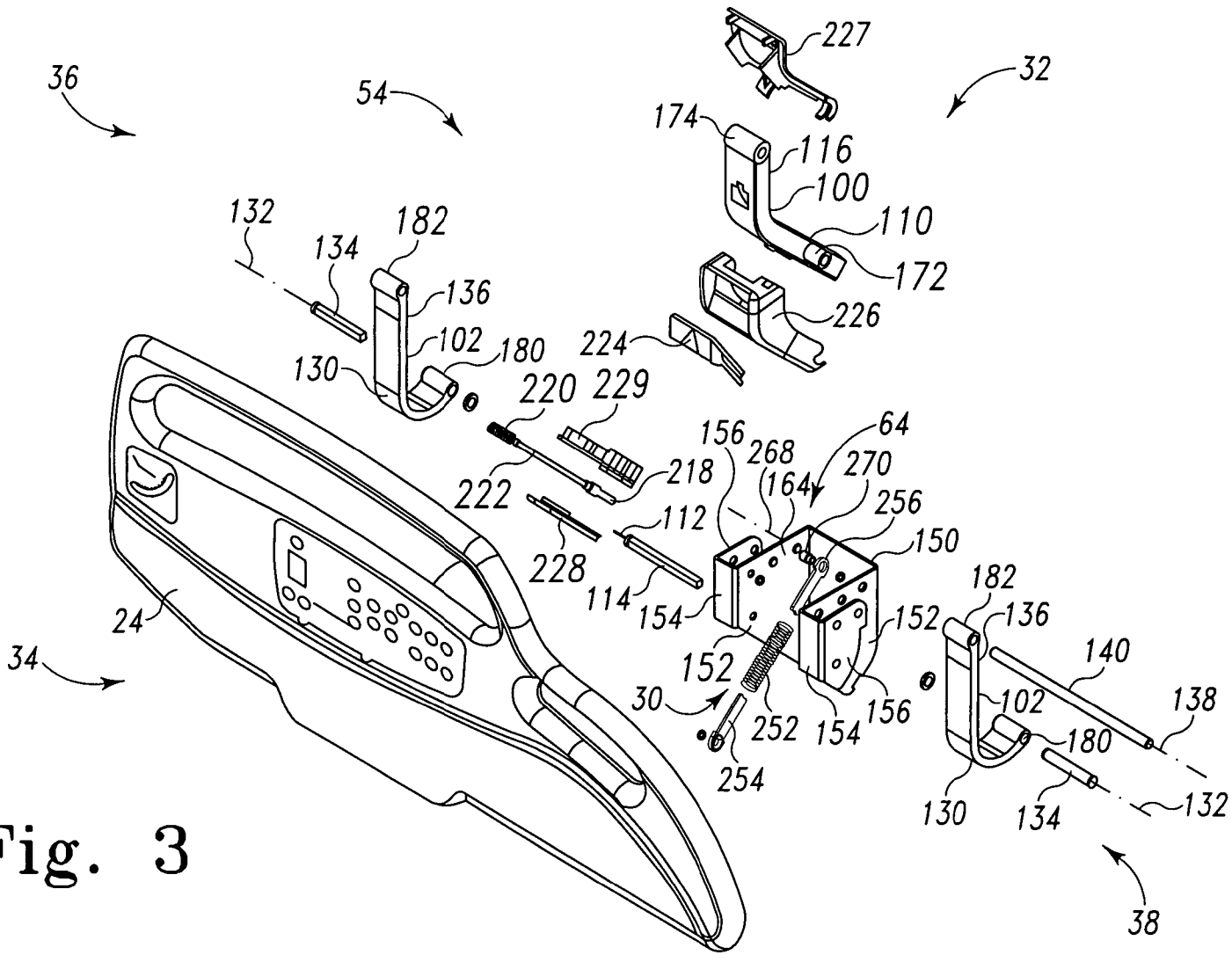
FIG. 3 is an exploded view similar to FIG. 2 of a linkage coupling a head end siderail to a right side of the head section.
Figure 4:
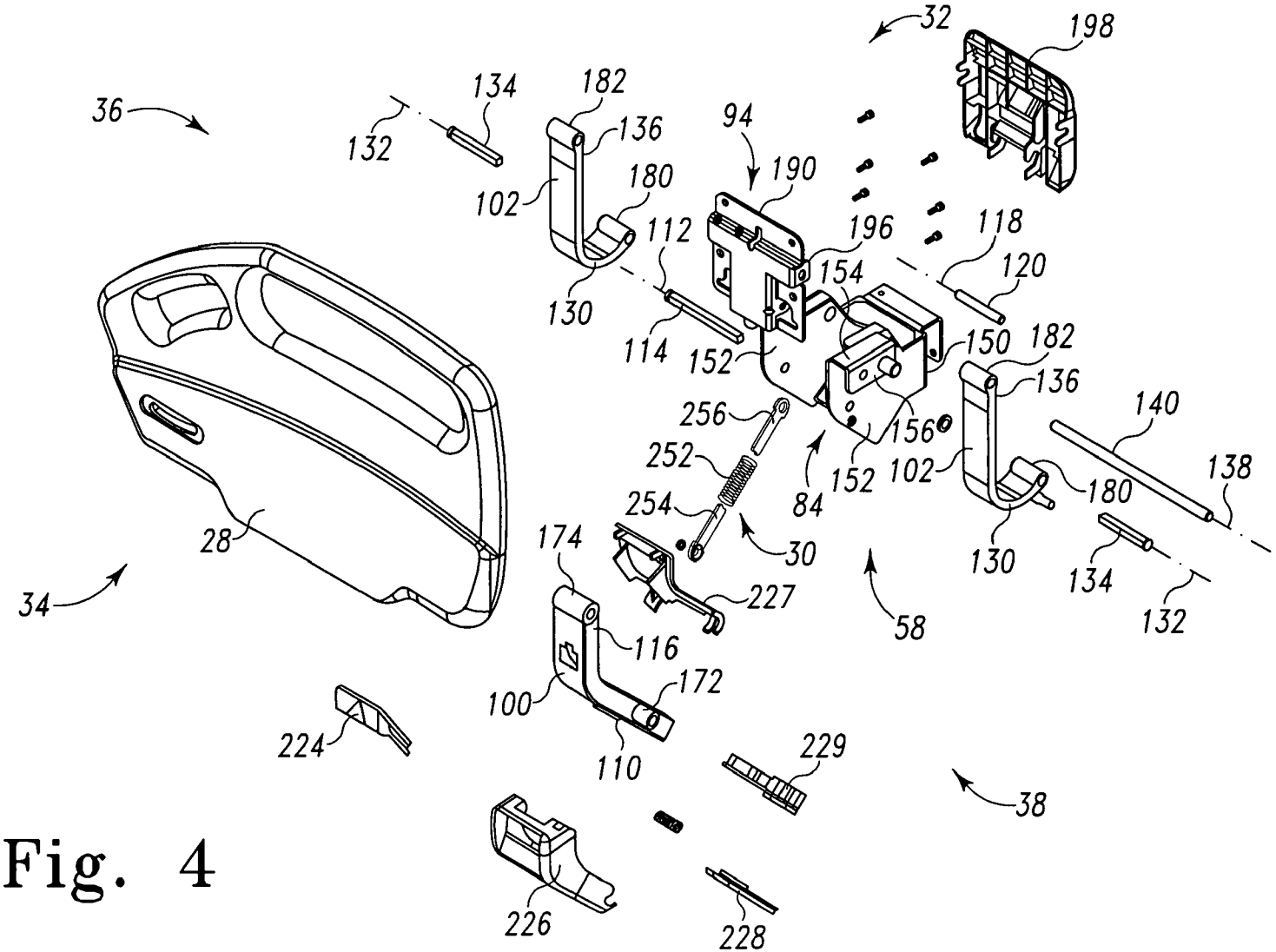
FIG. 4 is an exploded view similar to FIG. 3 of a linkage coupling a foot end siderail to a right side of the intermediate frame.
Figure 6:
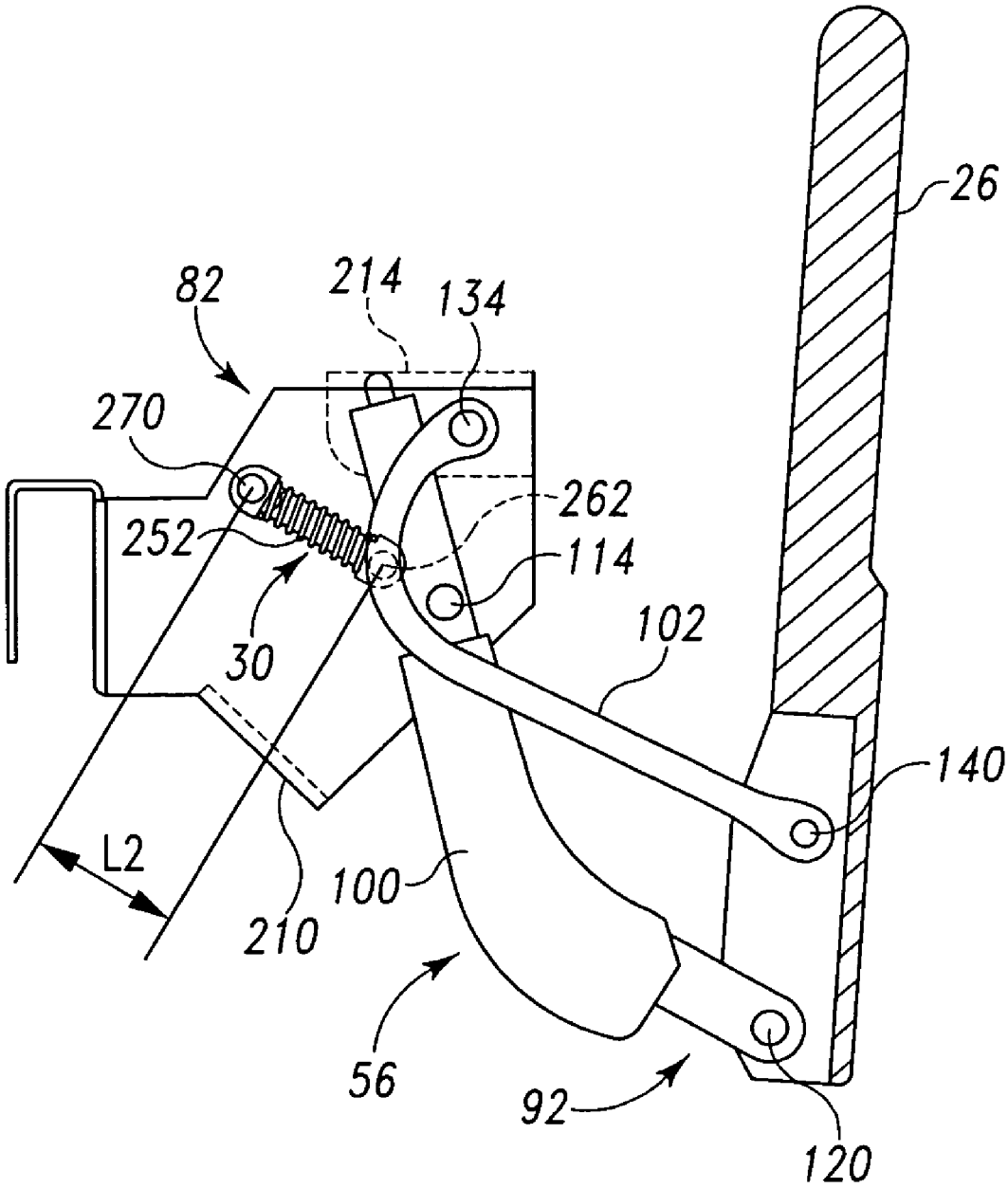
FIG. 6 is an end elevation view of a foot end siderail in an overcenter position.

The second link 256 of the dampener 30 is coupled to the frame mounting bracket 62 for pivoting movement about a pivot pin 270 shown in FIG. 3 and in FIGS. 5-7 with regard to siderail 26. The pivot pin 270 is secured to an inwardly facing wall 164 of the outwardly extending flange 152 of the frame mounting bracket 62 such that the dampener 30 is positioned between the center arm 100 and the associated outer arm 102 near the foot end 38. The location of the pivot pins 262, 270 coupling the spring 252 of the dampener 30 to the frame mounting bracket 62 and to the center arm 100 is such that the spring 252 resists the clockwise rotation of the center arm 100 as the siderail 22 moves from the raised position to an over-center position and such that the spring 252 assists the clockwise rotation of the center arm 100 after the siderail 22 passes the overcenter position. The direction of rotation of the center arm 100 refers to FIGS. 5-7.

Each outer arm 102 includes bushings 180, 182 near the respective lower and upper ends 130, 136 thereof. The outer arms 102 are positioned outside the frame mounting bracket 62. A first pivot pin 134 extends through a bore in the bushing 180 of the foot end outer arm 102 and then through respective openings in the inner and outer flanges 152, 156 of the frame mounting bracket 62 near the foot end 38 of the bed 20 to provide a pivotable connection therebetween. Retaining washers hold the first pivot pin 134 in place. Likewise a second pivot pin 134 extends through a bore in the bushing 180 of the head end outer arm 102 and then through respective openings in the inner and outer flanges 152, 156 of the frame mounting bracket 62 near the head end 36 of the bed 20 to provide a pivotable connection therebetween. The bores in the bushings 180 of the outer arms 102 and the associated openings in the inner and outer flanges of the frame mounting bracket 62 configured for receiving the pivot pins 134 are coaxially aligned. Retaining washers hold the pivot pin 134 in place.

The siderail mounting bracket 72 includes a base portion 190, a pair of leg portions 192 extending downwardly from the base portion 190, a pair of inner flanges 194 extending inwardly from the respective leg portions 192 and a pair of outer flanges 196 extending inwardly from the base portion 190. The spaced apart inner flanges 194 form an arm-receiving space 200 in which the upper end 116 of the center arm 100 is pivotally mounted for rotation about the pivot pin 120. To this end, a bushing 174 is secured to the upper end 116 of the center arm 100. The pivot pin 120 extends through an opening in the inner flange 194 of the siderail mounting bracket 72 near the foot end 38 of the bed 20, through a bore in the bushing 174 of the center arm 100, and then through an opening in the inner flange 194 of the siderail mounting bracket 72 near the head end 36 of the bed 20 to provide a pivotable connection therebetween. The openings in the inner flanges 194 of the siderail mounting bracket 72 and the bore in the bushing 174 of the center arm 100 configured for receiving the pivot pin 120 are coaxially aligned. The spacing between outer faces of the bushing 174 is slightly less than the spacing between the inner flanges 194. Retaining washers hold the pivot pin 120 in place. Numeral 198 designates a cover for the siderail mounting bracket 72.

The outer arms 102 are positioned outside the outer flanges 196 of the siderail mounting bracket 72. The pivot pin 140 extends through a bore in the bushing 182 near the upper end 136 of the foot end outer arm 102, through respective openings in the outer flanges 196 of the siderail mounting bracket 72 and then through a bore in the bushing 182 near the upper end 136 of the head end outer arm 102 to provide a pivotable connection therebetween. Retaining washers hold the pivot pin 140 in place. The bores in the bushings 182 of the outer arms 102 and the associated openings in the respective outer flanges 196 of the siderail mounting bracket 72 configured for receiving the pivot pin 140 are coaxially aligned. Retaining washers hold the pivot pin 140 in place.

Referring to FIGS. 5-7, a lower latch plate 210 is secured to a bottom wall 212 of the frame mounting bracket 62. An upper latch plate 214 is secured to a top wall 216 of the frame mounting bracket 62. A latch pin 218 is received in an opening in the lower latch plate 210 when the siderail 22 is raised (as shown in FIG. 5 with regard to the siderail 26) to lock the siderail 22 in the raised position. The latch pin 218 is received in an opening in the upper latch plate 214 when the siderail 22 is lowered (as shown in FIG. 7 with regard to the siderail 26) to lock the siderail 22 in the lowered position. A spring 220 biases the latch pin 218 toward the latch plates 210, 214. A cable 222 couples the latch pin 218 to a handle 224. The handle 224 is pivotally mounted to the center arm 100 by a mount 226. The mount 226 has a cover 227. The latch pin 218 is slidably mounted to the center arm 100 by a support 228. The support 228 has a cover 229. When the handle 224 is raised, the latch pin 218 is withdrawn from the respective openings in the latch plates 210, 214 to free the siderail 22 to move between the raised and lowered positions. When the handle 224 is released, the spring 220 causes the latch pin 218 to snap back into the respective openings in the latch plates 210, 214 to lock the siderail 22 in place. The lower end 110 of the center arm 100 engages a stop 230 as the siderail 22 arrives at the lowered position as shown, for example, in FIG. 7 with regard to the siderail 26.

The dampener 30 prevents the center arm 100 from free falling under the force of gravity when the siderail 22 is in the raised position and the lock holding the siderail 22 in the raised position is released. This may result in the siderail 22 slamming against the stop 230. Each dampener 30 includes the coil spring 252, the first link 254 and the second link 256, as previously mentioned. The first link 254 has a mount end 258 coupled to the center arm 100 for pivoting movement about a fifth axis 260 by a pivot pin 262. The first link 254 has a free end 264 received inside the spring 252. The second link 256 has a mount end 266 coupled to the frame mounting bracket 62 for pivoting movement about a sixth axis 268 by a pivot pin 270 as shown in FIG. 3. The second link 256 has a free end 272 received inside the spring 252. The location of the pivot pins 262, 270 coupling the dampener 30 to the respective center arm 100 and the frame mounting bracket 62 is such that the fifth axis 260 is positioned below the sixth axis 268. As the siderail 22 is moved to the lowered position, the spring 252 is compressed to resist the downward movement of the siderail 22. The links 254, 256 are also referred to herein as the spring guides.

Each link 254, 256 includes a head portion 280 and a body portion 282 extending outwardly from the head portion 280 along a longitudinal axis 284 thereof. The free end 281 of the body portion 282 is concave. The head portion 280 includes a bore 286. A split bushing 288 is inserted in the bore 286 in the first link 254. The bushing 288 includes a sleeve portion 290 that is received in the bore 286 and a flange portion 292 that extends upwardly and outwardly from the sleeve portion 290 along a central axis 294. The bushing 288 is also referred to herein as the bushing guide.

The body portions 282 of the links 254, 256 are received in the bore 253 of the spring 252 such that the free ends 264, 272 of the links 254, 256 overlap as shown in FIG. 9. The body portions 282 of the links 254, 256 extend generally parallel to a central axis 274 of the spring 252. The head portion 280 and the body portion 282 cooperate to form a seat portion 283. Opposite ends of the spring 252 rest against the seat portions 283 of the respective links 254, 256. The free ends 264, 272 of the links 254, 256 slide relative to each other as the siderail 22 is raised and lowered. The spring 252 initially compresses as the siderail 22 moves from the raised position to the overcenter position and then expands when the siderail 22 moves from the overcenter position to the lowered position. Likewise, the spring 252 initially compresses as the siderail 22 moves from the lowered position to the overcenter position and then expands when the siderail 22 moves from the overcenter position to the raised position. The links 254, 256 maintain orientation of the spring 252 along the longitudinal axis 274 extending between the pivot pins 262, 270 during the compression and expansion of the spring 252. The inner diameter of the spring 252 is greater than the width of the links 254, 256 to allow the links 254, 256 to slide freely, and yet maintain the axial orientation of the spring 252. Illustratively, the links 254, 256 are made from flat steel stock and the bushing 288 is made from a low friction composite material, such as PTFE.

The first link 254 is coupled to the center arm 100 for pivoting movement about the pivot pin 262. The pivot pin 262 is secured to an outwardly facing wall 104 of the center arm 100 near the lower end 110 thereof such that the pivot pin 262 is positioned below the pivot pin 114 when the siderail 22 is raised (as shown in FIG. 5 with regard to the siderail 26) and above the pivot pin 114 when the siderail 22 is lowered (as shown in FIG. 7 with regard to the siderail 26). The pivot pin 262 is formed to include a seat portion 296. The head portion 280 of the first link 254 is held on the pivot pin 262 between the seat portion 296 and a retaining washer 298 secured to the pivot pin 262 to provide a pivotable connection therebetween.

The second link 256 is coupled to the frame mounting bracket 62 for pivoting movement about the pivot pin 270 as shown in FIG. 3. The pivot pin 270 is secured to an inwardly facing wall 164 of the outwardly extending flange 152 of the frame mounting bracket 62. The pivot pin 270 is formed to include a seat portion 300. The head portion 280 of the second link 256 is held on the pivot pin 270 between the seat portion 300 and a retaining washer 302 secured to the pivot pin 270 to provide a pivotable connection therebetween.

The siderail 22 passes through an overcenter position (shown in FIG. 6 with regard to the siderail 26) during its movement between the raised position (shown in FIG. 5 with regard to the siderail 26) and the lowered position (shown in FIG. 7 with regard to the siderail 26). As the siderail 22 moves from the raised position to the overcenter position, the distance between the pivot pin 262 and the pivot pin 270 shortens from L1, shown in FIG. 5, to L2, shown in FIG. 6, and the spring 252 is compressed to resist the downward movement of the siderail 22. After the siderail 22 passes the overcenter position, the distance between the pivot pin 262 and the pivot pin 270 lengthens from L2, shown in FIG. 6, to L3, shown in FIG. 7, and the spring 252 expands to bias and assist the siderail 22 toward the lowered position.

The location of the pivot pins 262, 270 coupling the spring 252 to the frame mounting bracket 62 and the center arm 100 is such that the spring 252 resists the clockwise rotation 202 of the center arm 100 as the siderail 22 moves from the raised position to the overcenter position and such that the spring 252 assists the clockwise rotation 202 of the center arm 100 after the siderail 22 passes the overcenter position. The directions of rotation of the center arm 100 are in reference to FIG. 5-7. When the siderail 22 is in the overcenter position, the spring 252 is compressed more than when the siderail 22 is in any other position. Accordingly, when the siderail 22 is moving toward the overcenter position, either from the raised position or from the lowered position, the spring 252 compresses to resist such movement. In contrast, when the siderail 22 is moving away from the overcenter position, either toward the raised position or toward the lowered position, the spring 252 expands to assist such movement.

Although certain embodiments have been described in detail above, variations and modifications exist within the scope and spirit of this disclosure as described and as defined in the following claims.

The invention claimed is:

1. A patient support apparatus comprising:

a frame, a siderail, a linkage coupled to the siderail and coupled to the frame to guide movement of the siderail relative to the frame between a raised position and a lowered position, and a dampener including:

a coil spring defining an inner region and including a first end and a second end, a first link including a first end coupled to the linkage a portion of the first end being configured to engage the first end of the coil spring, and a second link including a first end coupled to the frame, a portion of the first end being configured to engage the second end of the coil spring, wherein the second end of the first link is not configured to engage the second end of the coil spring and the second end of the second link is not configured to engage the first end of the coil spring.

2. The apparatus of claim 1, wherein the siderail moves along a path with respect to the frame as the siderail moves between the raised position and the lowered position, wherein the first end of the first link and the first end of the second link cooperate to compress the coil spring from a first length to a second length to resist movement of the siderail along a first portion of the path.

3. The apparatus of claim 2, wherein the dampener is configured to expand from the second length to a third length to assist movement of the siderail along a second portion of the path.

4. The apparatus of claim 1, wherein the siderail has an overcenter position intermediate of the raised position and the lowered position, and the coil spring is more compressed when the siderail is in the overcenter position than any other position of the siderail.

5. The apparatus of claim 4, wherein the dampener biases the siderail toward the lowered position after the siderail passes the overcenter position during movement of the siderail from the raised position to the lowered position.

6. The apparatus of claim 1, wherein the siderail moves along a path with respect to the frame as the siderail moves between the raised position and the lowered position, the dampener resists movement of the siderail along a first portion of the path and the dampener assists movement of the siderail along a second portion of the path.

7. The apparatus of claim 1, wherein the second end of the first link and the second end of the second link are slidable relative to each other.

8. The apparatus of claim 1, wherein a portion of the second end of the first link and the second end of the second link overlap.

9. The apparatus of claim 1, wherein the second end of the first link and the second end of the second link do not extend outside the inner region.

10. A patient support apparatus comprising:

a frame, a siderail, a linkage coupled to the siderail at a first pivot and coupled to the frame at a second pivot, the linkage being configured to guide movement of the siderail between a raised position and a lowered position such that the second pivot moves along a first rotational path with respect to the first pivot, and a dampener coupled to the linkage at a third pivot and coupled to the frame at a fourth pivot, wherein the third pivot moves along a second rotational path with respect to the fourth pivot as the siderail moves between the raised position and the lowered position, wherein the third pivot moves along the second rotational path in a direction opposite the direction the second pivot moves along the first rotational path as the siderail moves between a raised position and a lowered position.

11. The apparatus of claim 10, wherein at least one of the third pivot and the fourth pivot are positioned above the second pivot when the siderail is in about the lowered position.

12. The apparatus of claim 10, wherein the dampener includes a hollow cylinder and a piston.

13. The apparatus of claim 10, wherein the dampener includes a first link, a second link, and a coil spring, the first link being coupled to the frame at the fourth pivot, the second link being coupled to the linkage at the third pivot, a portion of the first link and a portion of the second link being positioned within the coil spring and being configured to move with respect to one another.

14. The apparatus of claim 10, wherein the dampener is configured to compress from a first length to a second length to resist movement of the siderail along a first portion of the second rotational path and to expand from the second length to a third length to assist movement of the siderail along a second portion of the second rotational path.

15. A patient support apparatus comprising:

a frame, a siderail, a linkage including a first end, a second end, and a first pivot located between the first end and the second end configured to movably couple the linkage to the frame, the first end movably coupled to the siderail at a second pivot, the second end including a latching mechanism configured to maintain at least one orientation of the siderail with respect to the frame, the linkage being configured to guide movement of the siderail relative to the frame between a raised position and a lowered position, the siderail moves along a path with respect to the frame as the siderail moves between the raised position and the lowered position, and a dampener coupled to the frame at a third pivot and coupled to the linkage at a fourth pivot positioned between the latching mechanism and the pivot, the dampener being configured to compress from a first length to a second length to resist movement of the siderail along a first portion of the path and to expand from the second length to a third length to assist movement of the siderail along a second portion of the path.

16. The apparatus of claim 15, wherein the dampener includes a coil spring configured to compress along the first portion of the path to resist movement of the siderail and to expand along the second portion of the path to assist the movement of the siderail.

17. The apparatus of claim 15, wherein the dampener includes a first link, a second link, and a coil spring, the first link being coupled to the frame, the second link being coupled to the linkage, a portion of the first link and a portion of the second link being positioned within the coil spring and being configured to move with respect to one another.

18. The apparatus of claim 17, wherein the first link includes a first head portion and a first end portion and wherein the second link includes a second head portion and a second end portion, the first end portion and the second end portion being disposed within the coil spring.

19. The apparatus of claim 15, wherein the second pivot moves in a clockwise direction along a first path with respect to the first pivot as the siderail moves from the raised position to the lowered position, and wherein the fourth pivot moves in a counter-clockwise direction along a second path-with respect to the third pivot as the siderail moves between the raised position and the lowered position.

20. The apparatus of claim 15, wherein the dampener includes an elastic member configured to bias the dampener to assist movement of the siderail along the second portion of the path when the dampener expands from the second length to the third length.

21. The apparatus of claim 15, wherein the dampener is configured to compress from the second length to a third length to resist movement of the siderail along a third portion of the path as the siderail moves from the lower position to the upper position and to expand from the third length to a fourth length to assist movement of the siderail toward the upper position along a fourth portion of the path.

* * * * *